US005131635A

United States Patent [19]

Soofi

[11] Patent Number: 5,131,635

[45] Date of Patent: Jul. 21, 1992

[54] IMPACT PAD WITH RISING FLOW SURFACE

[75] Inventor: Madjid Soofi, St. Charles, Ill.

[73] Assignee: Magneco/Metrel, Inc., Addison, Ill.

[21] Appl. No.: 769,199

[22] Filed: Sep. 30, 1991

Related U.S. Application Data

[63] Continuation-in-part of Ser. No. 726,868, Jul. 8, 1991, which is a continuation of Ser. No. 530,164, May 29, 1990, Pat. No. 5,072,916.

[51] Int. Cl.[5] ..... C21B 7/14

[52] U.S. Cl. ..... 266/275; 266/229; 222/594

[58] Field of Search ..... 266/275, 287, 230, 231, 266/229; 222/594; 164/337, 437, 362, 335; 249/206

[56] References Cited

U.S. PATENT DOCUMENTS

| | | | |
|---|---|---|---|
| 1,727,565 | 9/1929 | Schall | 164/362 |
| 2,301,880 | 11/1942 | Johnston, Jr. | 266/278 |
| 2,406,380 | 8/1946 | Johnston, Jr. | 266/278 |
| 3,887,171 | 6/1975 | Neuhaus | 266/34 |
| 4,033,546 | 7/1977 | Guegan | 249/174 |
| 4,042,229 | 8/1977 | Eccleston | 266/275 |
| 4,177,855 | 12/1979 | Duchateau et al. | 164/82 |
| 4,209,162 | 6/1980 | Petiau | 249/206 |
| 4,591,135 | 5/1986 | Fosnacht et al. | 266/275 |
| 4,715,586 | 12/1987 | Schmidt et al. | 266/275 |
| 4,993,692 | 2/1991 | Brown et al. | 266/275 |

FOREIGN PATENT DOCUMENTS

| | | | |
|---|---|---|---|
| 2643009 | 3/1978 | Fed. Rep. of Germany . | |
| 1081253 | 6/1954 | France . | |
| 0065887 | 11/1955 | France . | |
| 2132517 | 11/1972 | France . | |
| 2278428 | 7/1974 | France . | |
| 2314789 | 1/1977 | France . | |
| 8008534 | 3/1978 | Japan . | |
| 632539 | 1/1988 | Japan . | |
| 0754573 | 4/1954 | United Kingdom | 249/206 |

*Primary Examiner*—Scott Kastler

*Attorney, Agent, or Firm*—Willian Brinks Olds Hofer Gilson & Lione

[57] ABSTRACT

An improved impact pad includes a plurality of channels which direct the flow of molten iron or steel toward the tundish drains, and ramps which elevate the flow in the directions of the drains. The ramps cause the molten iron or steel to follow a trajectory path after leaving the impact pad, first rising and then falling toward the drains. The trajectory path increases the residence time of the molten iron or steel in the tundish, allowing more time for impurities to float to the top of the vessel. The trajectory path also helps propel the impurities partially toward the top of the tundish vessel.

22 Claims, 3 Drawing Sheets

IMPACT PAD WITH RISING FLOW SURFACE

RELATED APPLICATIONS

This application is a continuation-in-part of Ser. No. 07/726,868, filed on Jul. 8, 1991, the entire disclosure of which is incorporated herein by reference. Ser. No. 07/726,868 is a continuation of Ser. No. 07/530,164, filed on May 29, 1990, now U.S. Pat. No. 5,072,916, the entire disclosure of which is incorporated herein by reference

FIELD OF THE INVENTION

This invention relates to an impact pad used in a tundish vessel to reduce turbulence and direct the flow of molten iron and steel within the vessel.

BACKGROUND OF THE INVENTION

In a tundish vessel of the type used in the iron and steel industry, there are typically variations in the purity of the molten iron or steel contained therein. When the molten iron and steel is in a nonagitated, nonturbulent state, impurities in the molten material tend to float to the top of the molten material, causing formation of a so-called "slag" layer. In other words, the purest of the molten iron or steel exists near the bottom of the vessel.

Molten iron or steel is poured into the tundish vessel from the top, and exits at the bottom. By maintaining a sufficient level or molten iron or steel in the vessel, and a sufficient residence time to allow impurities to float to the top, the concentration of impurities is reduced to a minimum in the lowermost portion of the vessel where the molten material leaves the vessel for further processing. Problems associated with impurities, occur, however, when the pouring of molten iron or steel into the tundish from the top creates sufficient agitation and turbulence that some of the slag material is forced downward into the lowermost portion of the tundish vessel, or is prevented from rising. Turbulence also occurs due to uneven and other undesirable flow patterns near the bottom of the vessel.

Various methods and devices have been invented for the purpose of reducing turbulence in a tundish vessel caused by the pouring of molten iron or steel into the vessel. In U.S. Pat. No. 4,177,855, a pair of swinging doors is shown in which helps protect the slag layer from turbulence caused by the pouring of molten metal. A flat impact pad provides an elevated splashing surface which helps contain the turbulence between the swinging doors.

U.S. Pat. No. 4,042,229 discloses an impact pad having a pair of sidewalls for inhibiting the flow of the molten iron or steel to the sidewalls of the tundish vessel. A second pair of sidewalls positioned far above the impact pad, helps separate the pouring region from the slag layer.

German patent 2,643,009 discloses a splash plate which includes a plurality of interlocking protrusions arranged in a honeycomb configuration.

Some of the prior art impact pads have facilitated the reduction of turbulence which causes impurities in the slag layer from becoming mixed with the molten iron or steel near the bottom of the vessel. Generally, these prior art devices have not facilitated the removal of impurities already present in the molten iron or steel when it enters the tundish vessels. In order to obtain the purest of molten steel from the tundish, attention must be given to removing already existing impurities as well as preventing impurities from being introduced into the product.

SUMMARY OF THE INVENTION

The present invention is directed toward a tundish impact pad which has one or more channels for directing the flow of the molten iron or steel toward drains located at one or both ends of the tundish vessel, whose flow channels have a base that rises in the direction of flow. The rising flow surface, alternatively referred to as a ramp, has an angle from the horizontal which is large enough so that the molten iron or steel does not flow directly to the drain along the bottom of the vessel but instead rises somewhat before falling back toward the drain. On the other hand, the angle of the ramp should not be so large as to cause the molten iron or steel to mix with the slag layer on its way to the drain.

This temporary rise in the flow of molten iron or steel improves the purity of the molten material in two ways. First, the residence time in the tundish vessel is increased, allowing impurities in the molten material more time to float to the top of the tundish vessel and become part of the slag layer. Second, the flow stream which rises away from the impact pad helps push the impurities upward and closer to the slag layer.

In order for the rising flow surface to serve its intended function of causing the molten iron or steel to flow slightly upward on its way to the drain, it is important that the impact pad have one or more flow channels for directing the flow of molten iron or steel in the direction of the drain. A flow channel is defined herein to include any structural configuration on the impact pad which is characterized by two walls or upward protrusions having a lower surface or base therebetween and having one or more outlets in the direction of a drain in a tundish vessel. A flow channel is further defined as being free of any crosshatching or other obstructions which would prevent molten iron or steel within the channel from flowing to an outlet. In the absence of a suitable flow channel, a rising flow surface provided in the direction of the drain would merely serve to redirect the flow, undesirably, toward the sides of the tundish vessel.

With the foregoing in mind, it is a feature and advantage of the invention to provide an improved impact pad having one or more flow channels with ramped lower surfaces, for directing the flow of molten iron or steel in a slightly upward trajectory falling as the molten iron or steel approaches the drain or drains.

It is also a feature and advantage of the invention to provide an impact pad which increases the residence time of molten iron or steel in a tundish vessel, allowing more time for impurities to float to the top of the tundish vessel.

It is also a feature and advantage of the invention to provide an impact pad which directs the impurities entrained in molten iron or steel partially toward the top of the tundish vessel.

It is also a feature and advantage of the invention to provide an impact pad which reduces the amount of impurities contained in molten iron or steel leaving the tundish vessel.

It is also a feature and advantage of the invention to provide an improved tundish vessel which produces a cleaner, higher quality molten iron or steel intermediate product.

The foregoing and other features and advantages of the invention will become further apparent form the following detailed description of the presently preferred embodiments, made with reference to the accompanying figures. This detailed description is intended to be illustrative rather than limitative, the scope of the invention being defined by the appended claims and equivalents thereof.

DETAILED DESCRIPTION OF THE PRESENTLY PREFERRED EMBODIMENTS

Figure 1:
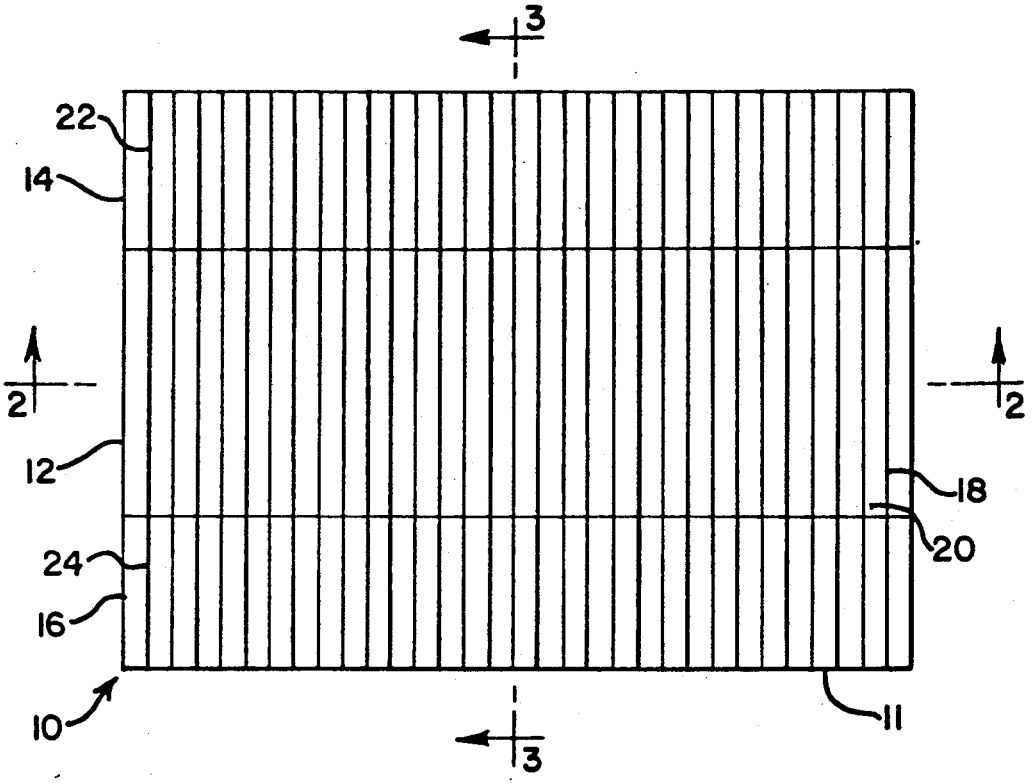
FIG. 1 is a top plan view of a tundish impact pad of the invention, having a plurality of sinusoidal flow channels with rising flow surfaces at both ends.
Figure 2:
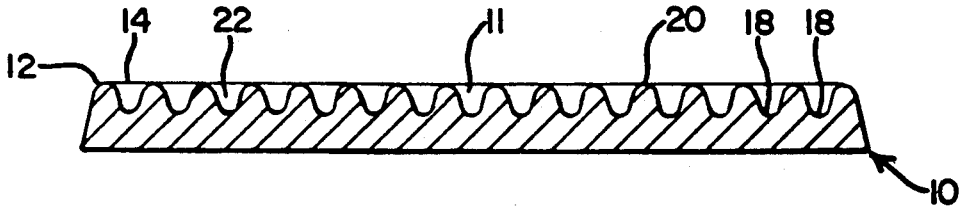
FIG. 2 is a sectional view of the impact pad of FIG. 1, taken along the line 2—2, and illustrates the sinusoidal flow channels.
Figure 3:
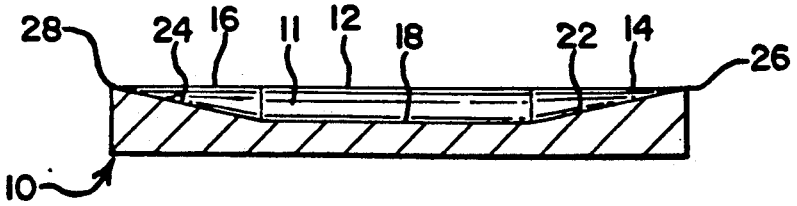
FIG. 3 is a sectional view of the impact pad of FIG. 1, taken along the line 3—3, and illustrates the rising flow surfaces at both ends of a flow channel.

Referring first to FIGS. 1-3, an impact pad 10 of the invention is shown which has a receiving surface 11 for receiving molten iron or steel being poured from a ladle (not shown). The receiving surface 11 has a center portion 12 and two end portions 14 and 16. The receiving surface 11 includes a plurality of flow channels 18 which direct the flow of molten iron or steel from the center portion 12 to the end portions 14 and 16 and, ultimately, toward drains in a tundish vessel.

The channels 18 from part of a sinusoidal wave pattern 20 which reduces turbulence and helps prevent molten iron or steel from flowing in a direction perpendicular to the channels 18 toward the sidewalls in a tundish vessel. The effects of sinusoidal wave patterns on turbulence reduction are discussed in detail in the parent U.S. patent application Ser. Nos. 07/726,868 and 07/530,164, the entire disclosures of which are incorporated by reference. The purposes of minimizing flow in a direction perpendicular to the channels 18 are to minimize regions of stagnation adjacent to the sidewalls in a tundish and to reduce turbulence which results from uneven and inconsistent flow patterns. The channels 18 are preferably configured in a sinusoidal wave pattern 20 as shown, but this is not required. Nonsinusoidal wave patterns, or nonwave configurations, may alternatively be used to define the channels.

The center portion 12 of the receiving surface 11 is completely sinusoidal as shown in FIG. 2. At both end portions 14 and 16, the lowermost portions of the channels 18 are characterized by gradually rising flow surfaces 22 and 24 as shown in FIG. 3. The term "flow surface" is defined herein as the lowermost portion of any channel, i.e. the surface over which the molten iron or steel flows. In the embodiment of FIGS. 1-3, the flow surfaces 22 and 24 rise steadily at an angle of about 40 degrees above the horizontal throughout the respective end portions 14 and 15, until the channels 18 become nonexistent at the far ends 26 and 28 of the receiving surface 11.

Figure 7:
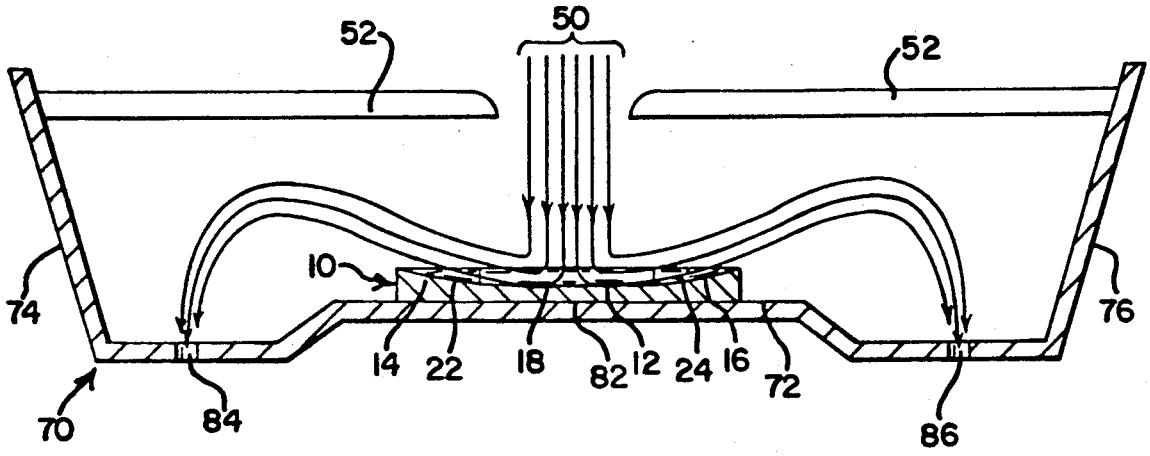
FIG. 7 shows a side sectional view of a tundish vessel including an impact pad of the type shown in FIGS. 1-3, with molten steel being poured therein.
Figure 8:
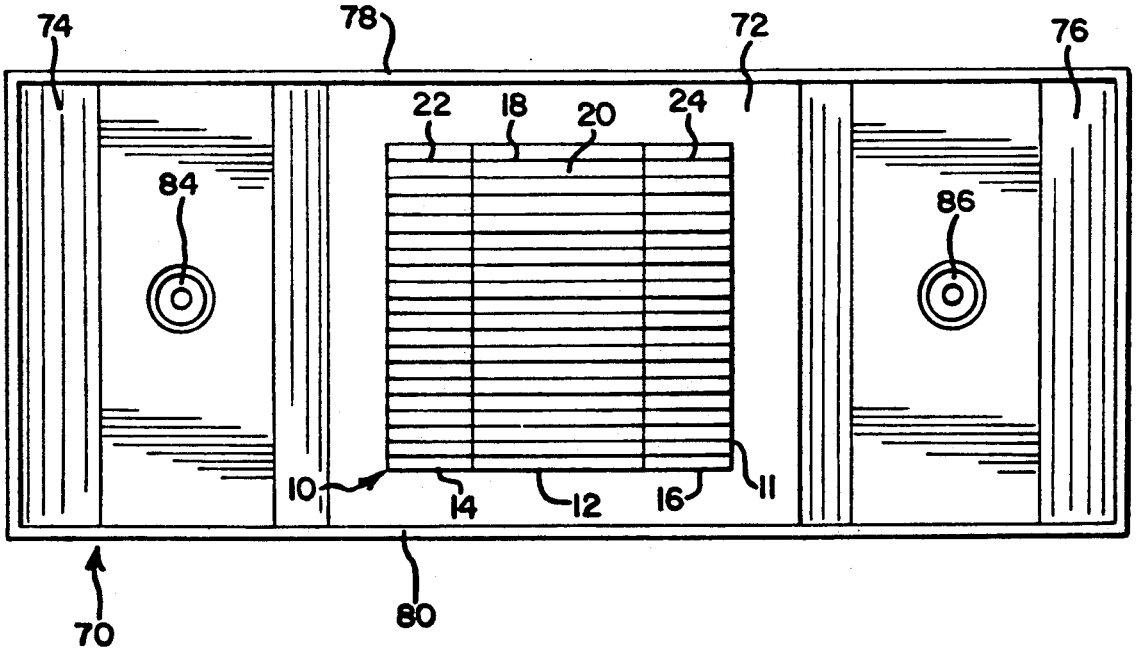
FIG. 8 is a top plan view of the tundish vessel of FIG. 7, without the molten steel.

The angle of the rising flow surfaces 22 and 24 must be carefully chosen so that molten iron or steel flowing from the impact pad 10 toward the drains in a tundish vessel will rise as far as possible without mixing with impurities from the slag layer, and then fall. FIGS. 7 and 8 illustrate the positioning and operation of the impact pad 10 of the invention inside a tundish vessel. FIG. 7 is a side sectional view of a tundish vessel 70 utilizing the tundish impact pad 10 of the invention, and also showing the flow of molten steel 50 relative to the slag layer 52. FIG. 8 is a top plan view of the tundish vessel of FIG. 7, without the molten steel.

The tundish vessel 70 has a floor 72, a back wall 74, a front wall 76 and two side walls 78 and 80. The floor 72 includes a region of impact 82 which is approximately centrally located between the back wall 74 and the front wall 76. The region of impact is defined herein as the portion of the floor 72 which lies directly underneath the molten steel 50 as it is being poured into the tundish 70. The impact pad 10 is placed on the floor 72 so that its central region 12 approximately coincides with the region of impact 82 of the tundish vessel 70, and so that its end regions 14 and 16 point toward the drains 84 and 86, respectively. The floor 72 also includes a first drain 84 which is located near the front wall 74 and a second drain 86 which is located near the back wall 76.

The molten steel 50 is poured into the tundish vessel 70 from above, onto the central region 12 of the receiving surface 11 of the impact pad 10. The channels 18, arranged in a sinusoidal pattern 20, reduce turbulence and direct the flow of the molten steel to the end portions 14 and 16 of the receiving surface 11, and ultimately toward the drains 84 and 86. The rising flow surfaces 22 and 24 cause the molten steel 50 to follow a trajectory path, first rising and then falling toward the drains 84 and 86 as illustrated by the arrows. The molten steel trajectory does not, however, rise to a level sufficient to displace, disturb or mix with the slag layer 52 floating near the top of the tundish vessel 70.

Therefore, the optimum angle of the rising flow surfaces will vary depending on the size and shape of the tundish vessel, the distance between the floor 72 and the slag layer 52, the distances between the region of impact 82 and the drains 84 and 86, the flow rate of the molten steel 50, the height from which the molten steel 50 is being poured, and other factors. In most cases, however, the optimum angle of each of the rising flow surfaces will be between about 20 and 60 degrees above the horizontal. More commonly, the optimum angle of each rising flow surface will be between about 30 and 50 degrees above the horizontal. Most commonly, the optimum angle will be about 40 degrees above the horizontal.

Figure 4:
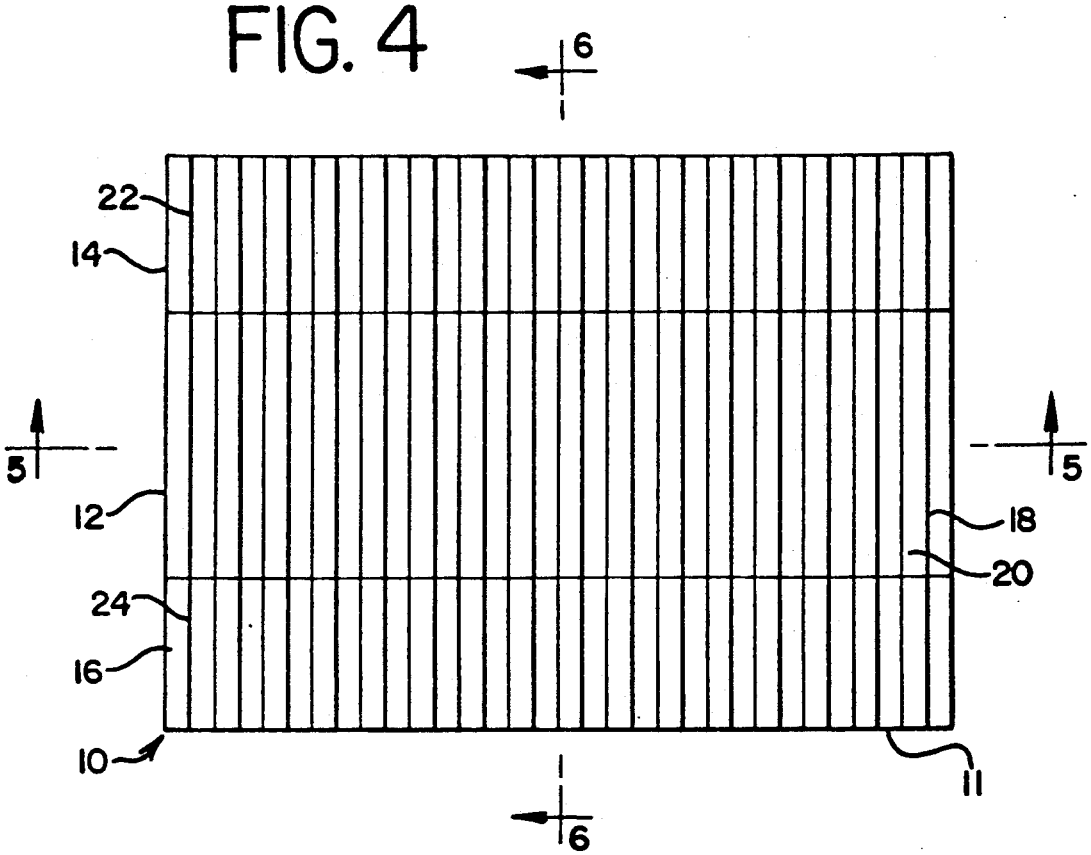
FIG. 4 is a top plan view of a second embodiment of a tundish impact pad of the invention, having a plurality of sinusoidal flow channels with rising flow surfaces at both ends.
Figure 5:
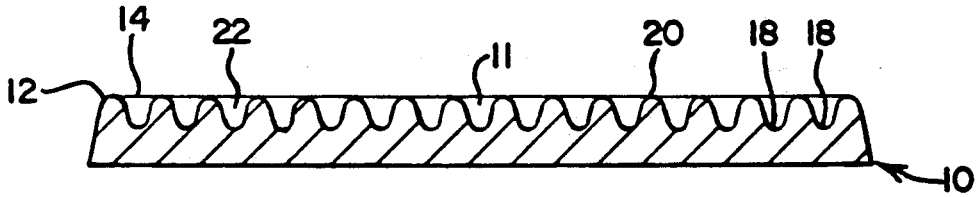
FIG. 5 is a sectional view of the impact pad of FIG. 4, taken along line 5—5, and illustrates the sinusoidal flow channels.
Figure 6:
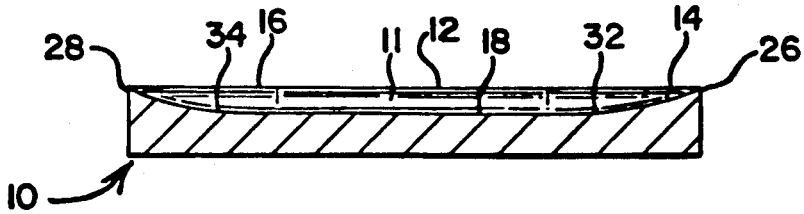
FIG. 6 is a sectional view of the impact pad of FIG. 4, taken along line 6—6, and illustrates the rising flow surfaces at both ends of a flow channel.

FIGS. 4-6 illustrate a preferred embodiment of the impact pad 10 of the invention. The parts of the embodiment of FIGS. 4-6 which correspond to the embodiment of FIGS. 1-3 have been given the same reference numerals. The embodiment of FIGS. 4-6 resembles the embodiment of FIGS. 1-3 except for the rising floor surfaces 32 and 34 shown in FIG. 6. Instead of rising steadily as in the straight ramps 22 and 24 of FIG. 3, the rising flow surfaces 32 and 34 of FIG. 6 have a curved profile which rises more slowly initially in order to facilitate a smoother flow transition between the center portion 12 and the end portions 14 and 16 of the receiving surface 11. These curved ramps 32 and 34 cause further reduction in turbulence especially when the molten iron or steel is flowing fast. The molten iron or steel initially rises slowly, and then rises at an increasing rate as it flows through the end regions 14 and 16.

When the impact paid of FIGS. 4–6 is utilized, the trajectory flow of the molten iron or steel after leaving the impact pad is governed primarily by the maximum angle of the ramps 32 and 34, i.e., the angle of the ramps occurring nearest to the far ends 26 and 28 of the impact pad 10. Generally, the optimum maximum angle of the ramps 32 and 34 is between about 30 and 75 degrees above the horizontal. More commonly, the maximum angle of the ramps should be between about 40 and 65 degrees above the horizontal. Most commonly, a maximum ramp angle of about 60 degrees is preferred.

The impact pad of the invention is constructed from a high temperature-resistant refractory composition which is capable of withstanding continuous exposure to molten iron or steel at temperatures of up to 3000 degrees Fahrenheit. Preferably, the impact pad is constructed from a refractory material containing 60–85 weight per cent $Al_2O_3$, 38–13 weight per cent $SiO_2$, 0.9–0.5 weight per cent CaO, and 1–0.5 weight per cent $Fe_2O_3$. Other suitable refractory materials including MgO, SiC, $Cr_2O_3$ and $ZrO_2$ may also be utilized. The composition of the impact pad is not limited to the named materials. Any refractory material can be used, so long as the impact pad will be able to withstand continuous, long term exposure to molten iron or steel.

While the embodiments disclosed herein are presently considered to be preferred, it is understood that various modifications and improvements can be made without departing from the spirit and scope of the invention. For example, the impact pad may form part of the integral structure of the tundish vessel. The scope of the invention is indicated in the appended claims, and all changes that are within the meaning and range of equivalency are intended to be embraced therein.

I claim:

1. An impact pad for use in a tundish vessel, comprising:

a receiving surface having a central region and two end regions adjacent to the central region;

a plurality of rectilinear curved protrusions in the receiving surface for guiding the flow of molten iron or steel from the central region toward the two end regions, the curved protrusions extending through the central region and into both end regions; and a ramp in each of the end regions intersecting with the curved protrusions, for causing molten iron or steel which flows through an end region to flow a trajectory path after leaving the impact pad.

2. The impact paid of claim 1 wherein the ramps are straight, causing molten steel to rise steadily as it flows through the end regions.

3. The impact pad of claim 2 wherein the ramps are configured at angles of between about 20 and about 60 degrees above horizontal.

4. The impact pad of claim 3 wherein the ramps are configured at angles of between about 30 and 50 degrees above horizontal.

5. The impact pad of claim 4 wherein the ramps are configured at angles of about 40 degrees above horizontal.

6. The impact pad of claim 1 wherein the ramps are curved, causing molten steel to rise at an increasing rate as it flows through the end regions.

7. The impact pad of claim 6 wherein the ramps are configured to have maximum angles of between about 30 and 75 degrees above horizontal.

8. The impact pad of claim 7 wherein the ramps are configured to have maximum angles between about 40 and 65 degrees above horizontal.

9. The impact pad of claim 8 wherein the ramps are configured to have maximum angles of about 60 degrees above the horizontal.

10. The impact pad of claim 1 wherein the curved protrusions define a plurality of flow channels.

11. The impact pad of claim 10 wherein the curved protrusions are configured in a sinusoidal pattern which defines the plurality of flow channels.

12. In a tundish vessel used in the iron and steel industry which includes a floor, a back wall, a front wall, two sidewalls, a region of impact located on the floor approximately centrally between the back and front walls, a first drain located on the floor near the back wall and a second drain located on the floor near the front wall, the improvement comprising an impact pad located on the floor in the region of impact, the impact pad comprising:

a receiving surface having a central region which approximately coincides with the region of impact and two end regions which point-toward the drains;

a plurality of rectilinear curved protrusions defining one or more channels in the receiving surface, the curved protrusions extending from the central region into the end regions, in the directions of the drains; and a flow surface in the bottom of the one or more flow channels which progressively rises in the end regions of the receiving surface toward the drains.

13. The tundish vessel of claim 12 wherein the flow surface rises steadily in the end regions of the receiving surface toward the drains.

14. The tundish vessel of claim 12 wherein the flow surface rises at an increasing rate in the end regions of the receiving surface toward the drains.

15. The tundish vessel of claim 12 wherein the receiving surfaces comprise a sinusoidal wave pattern defining a plurality of flow channels.

16. The tundish vessel of claim 12 wherein the flow channels extend substantially through the end regions of the receiving surface.

17. The tundish vessel of claim 12 wherein the impact pad forms part of the integral structure of the tundish vessel.

18. In a tundish vessel used in the iron and steel industry which includes a floor, a back wall, a front wall, two sidewalls, a region of impact and a drain, the improvement comprising an impact pad located in the region of impact which has a plurality of rectilinear curved protrusions defining channels pointing in the direction of the drain, and a ramp which rises in the direction of the drain.

19. The tundish vessel of claim 18 wherein the curved protrusions comprise a sinusoidal wave pattern defining the channels at least in part.

20. The tundish vessel of claim 18 wherein the ramp is straight.

21. The tundish vessel of claim 18 wherein the ramp is curved.

22. The tundish vessel of claim 18 wherein the impact pad forms part of the integral structure of the tundish vessel.

* * * * *

UNITED STATES PATENT AND TRADEMARK OFFICE

CERTIFICATE OF CORRECTION

PATENT NO. : 5,131,635

DATED : July 21, 1992

INVENTOR(S) : MADJID SOOFI

It is certified that error appears in the above-indentified patent and that said Letters Patent is hereby corrected as shown below:

IN THE ABSTRACT

On the title page, under the heading "Abstract," in the fifth line, please delete "trajactory" and substitute therefor --trajectory--.

Column 1, line 29, after "level" please delete "or" and substitute therefor --of--.

Column 3, line 2, please delete "form" and substitute therefor --from--.

Column 3, line 47, please delete "from" and substitute therefor --form--.

Column 5, line 12, please delete "paid" and substitute therefor --pad--.

UNITED STATES PATENT AND TRADEMARK OFFICE

CERTIFICATE OF CORRECTION

PATENT NO. : 5,131,635

DATED : July 21, 1992

INVENTOR(S) : MADJID SOOFI

It is certified that error appears in the above-indentified patent and that said Letters Patent is hereby corrected as shown below:

IN THE CLAIMS

Col. 5, Claim 2, line 63, please delete "paid" and substitute therefor --pad--.

Col. 6, Claim 12, line 36, please delete "point-toward" and substitute therefor --point toward--.

Signed and Sealed this

Twelfth Day of April, 1994

Bruce Lehman

BRUCE LEHMAN

*Commissioner of Patents and Trademarks*

*Attest:*

*Attesting Officer*